US010593161B1

(12) United States Patent
Shoemaker, Jr.

(10) Patent No.: US 10,593,161 B1
(45) Date of Patent: Mar. 17, 2020

(54) ARCADE GAME AND VENDING MACHINE SYSTEM

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 16/519,215

(22) Filed: Jul. 23, 2019

(51) Int. Cl.
*G07F 17/32* (2006.01)

(52) U.S. Cl.
CPC ..... *G07F 17/3295* (2013.01); *G07F 17/3223* (2013.01); *G07F 17/3253* (2013.01)

(58) Field of Classification Search
CPC ..... G07F 17/3295; G07F 17/3223; G07F 17/3253
See application file for complete search history.

(56) References Cited

U.S. PATENT DOCUMENTS

| | | | | |
|---|---|---|---|---|
| 6,336,636 | B1 * | 1/2002 | Smart | A63F 9/30 273/447 |
| 2005/0269768 | A1 * | 12/2005 | Singer | G07F 17/32 273/138.1 |
| 2011/0195775 | A1 * | 8/2011 | Wells | G07F 9/026 463/29 |
| 2012/0190417 | A1 * | 7/2012 | Balaban | A63F 9/30 463/9 |

* cited by examiner

*Primary Examiner* — Jeffrey S Vanderveen
(74) *Attorney, Agent, or Firm* — Fulwider Patton LLP

(57) ABSTRACT

A system that uses a vending machine and an arcade game of skill in combination. The vending machine can be a beverage machine that dispenses cold beverages for a specified price, and includes a refrigerated compartment for keeping the beverages cold. Next to the vending machine is an arcade game that allows a player to win the items sold with the vending machine. A patron is offered the choice of trying to win the item using the arcade game, or simply use the vending machine to acquire the item. If the item is successfully won using the arcade game, the arcade game uses a signal that is send to the vending machine to dispense the item won from its inventory, and the item or card in the arcade game is returned to the playing field.

11 Claims, 17 Drawing Sheets

ARCADE GAME AND VENDING MACHINE SYSTEM

BACKGROUND

Vending machines conveniently provide beverages, foodstuffs, novelties, sundries, and a variety of other items to patrons in exchange for payment. An advantage of vending machines is that they can store a large quantity of the items to be distributed, and if necessary keep the items chilled or refrigerated before being delivered to a customer using a refrigeration unit. Arcade games also can be used to exchange prizes for payment, but have a more limited capability for storage and need to be constantly restocked in order to prevent a prize area from appearing empty or depleted. Each type of machine alone has certain clear drawbacks.

SUMMARY OF THE INVENTION

The present invention is a system that employs a vending machine and an arcade game of skill in combination. In a first preferred embodiment, the vending machine is a beverage machine that dispenses cold beverages for a specified price (although other types of products are not excluded from the present invention). The vending machine includes a refrigerated compartment for keeping the beverages cold and ready to drink. Adjacent the vending machine is an arcade game such as that described in U.S. patent application Ser. No. 16/352,532 and U.S. Pat. No. 8,070,167, the contents of which are fully incorporated herein by reference. A patron is offered the choice of playing the arcade game and trying to win a beverage dispensed in the vending machine, or simply using the vending machine to purchase the beverage. If the beverage is successfully won using the arcade game, the arcade game sends a signal to the vending machine to dispense the item won from its inventory, and the item in the arcade game is left in the game. The game preserves the inventory of the arcade game and utilizes the larger storage and refrigeration capability of the vending machine, and attracts players as well as patrons to increase sales of the beverages. These and other features of the present invention will best be understood with reference to the included drawings and the detailed description of the preferred embodiments below.

DETAILED DESCRIPTION OF THE PREFERRED EMBODIMENTS

Figure 1A:
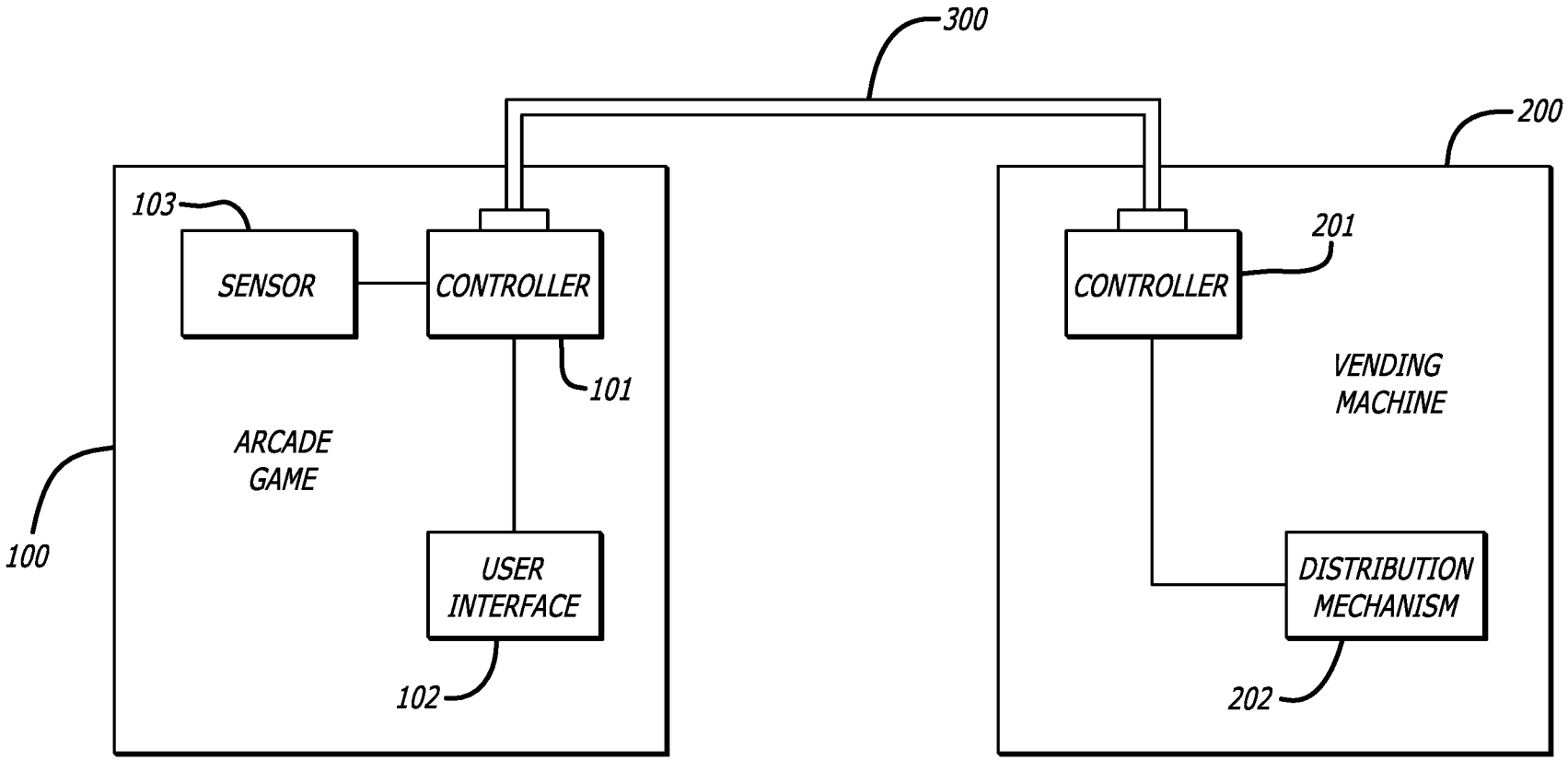
FIG. 1A is a schematic diagram of the arcade game/vending machine system of the present invention using a wired connection.
Figure 1B:
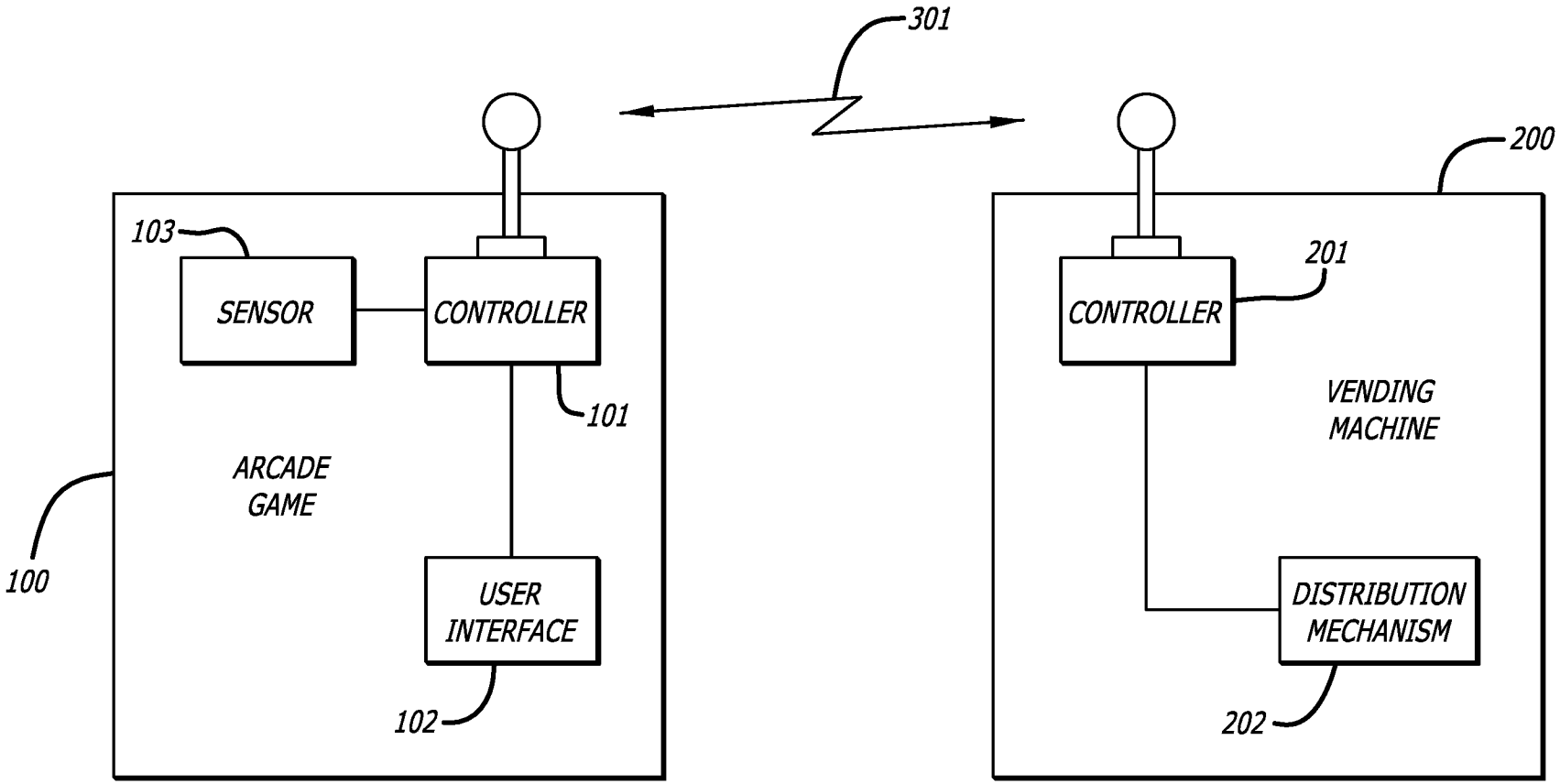
FIG. 1B is a schematic diagram of the arcade game/vending machine system of the present invention using a wireless connection.

FIGS. 1A and 1B illustrate first preferred embodiments of the present invention, where an arcade game 100 is located adjacent a vending machine 200 and the two devices are connected by a data bus 300, 301. The arcade game 100 generally includes an arcade game controller 101 that manages the devices of the arcade game, including player controls/user interface 102 and a sensor 103 or a switch (not shown), used to determine success or failure of the player attempt. The vending machine 200 generally includes a vending machine controller 201 that manages the vending machine operation, including the distribution mechanism 202 for retrieving a product from inventory and delivering the product to a pick-up bin/window/portal 203. The data bus can be a wired connection 300 or a wireless connection 301, including wifi, bluetooth, LAN, or any other way to send data from one machine to the other.

Figure 2:
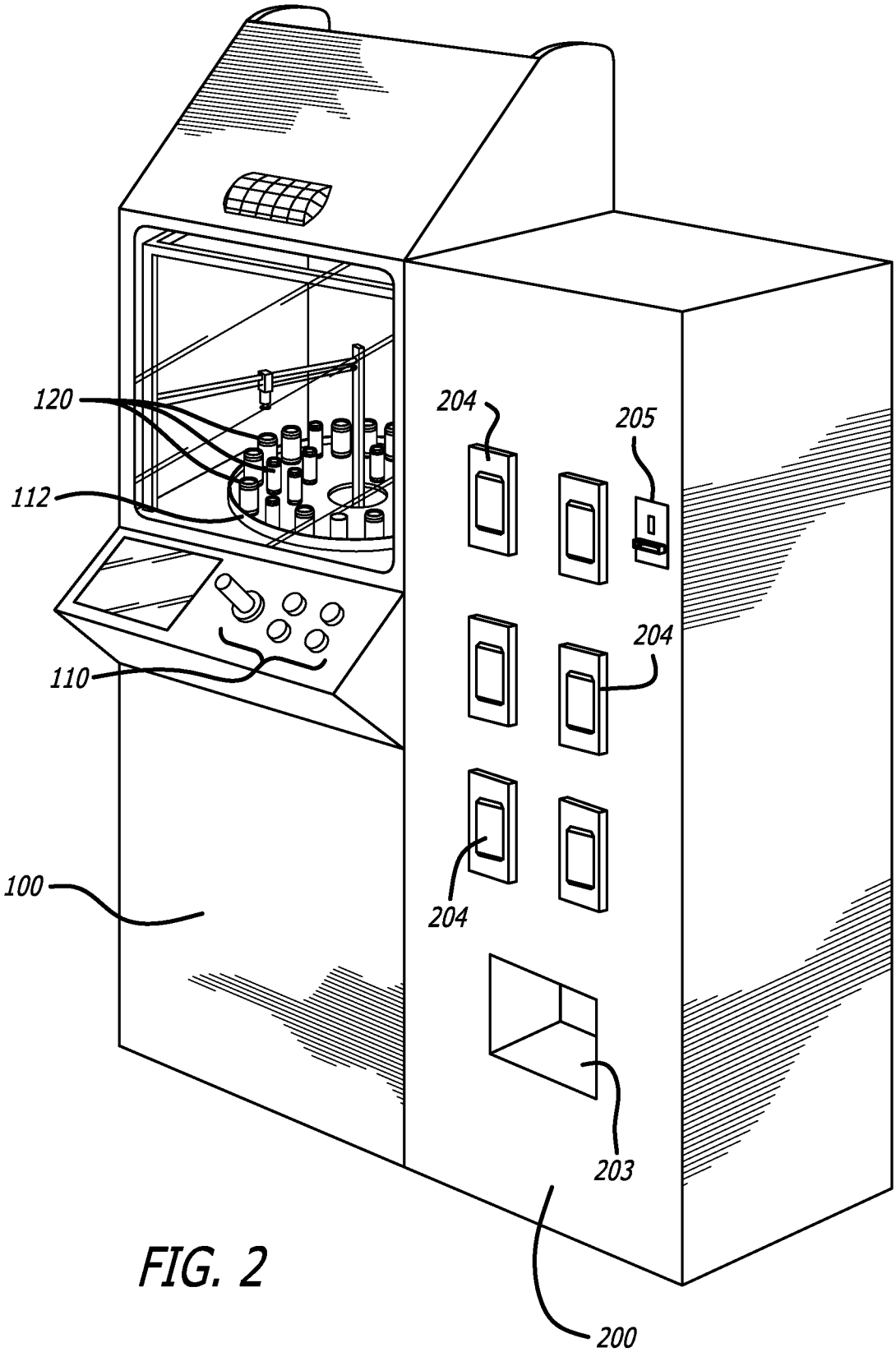
FIG. 2 is an elevated, perspective view of a first preferred embodiment of the present invention.
Figure 9:
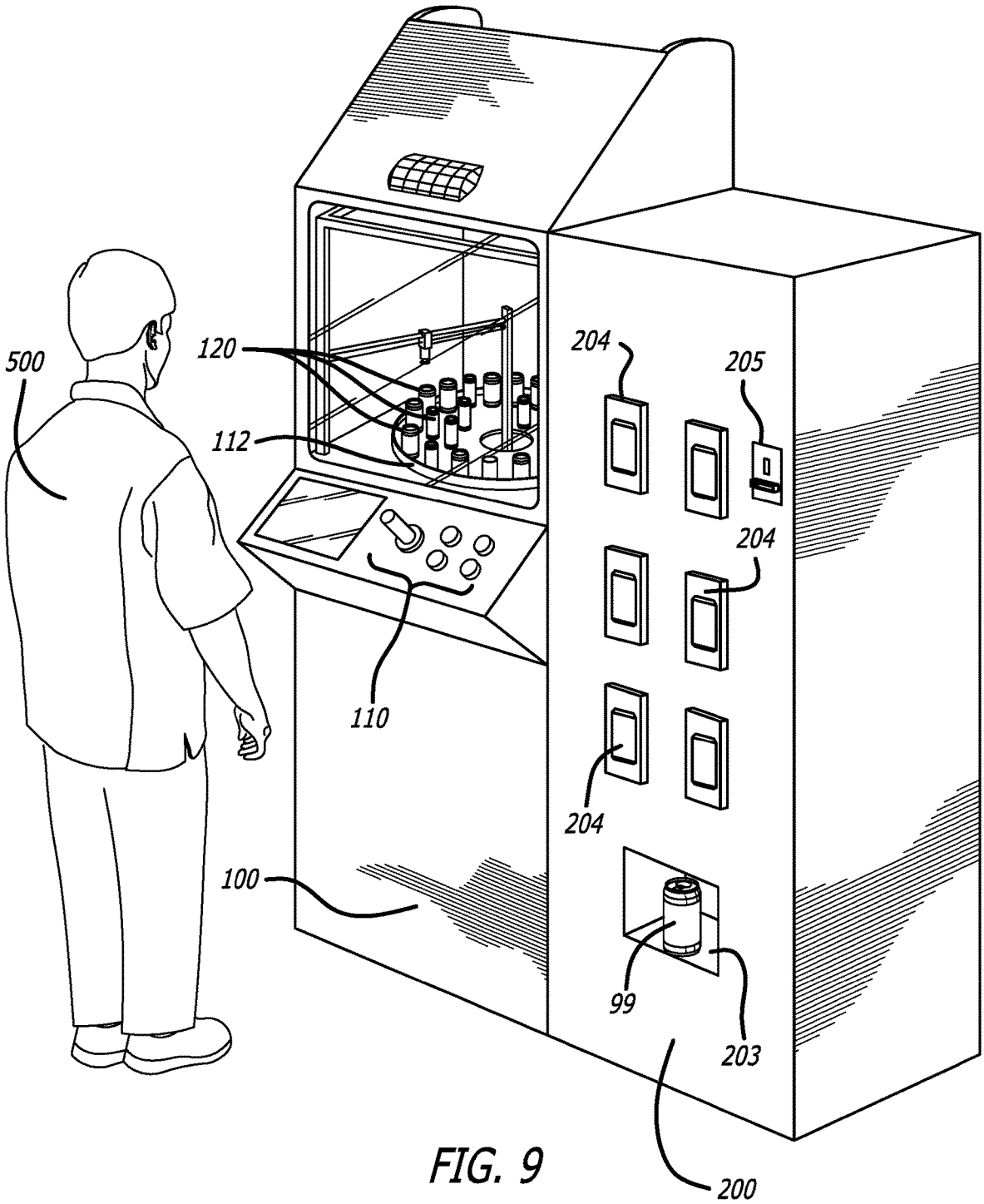
FIG. 9 is a perspective view of the embodiment of FIG. 2 with the system returning a beverage in the vending machine of the type won by the patron in the arcade game.
Figure 10:
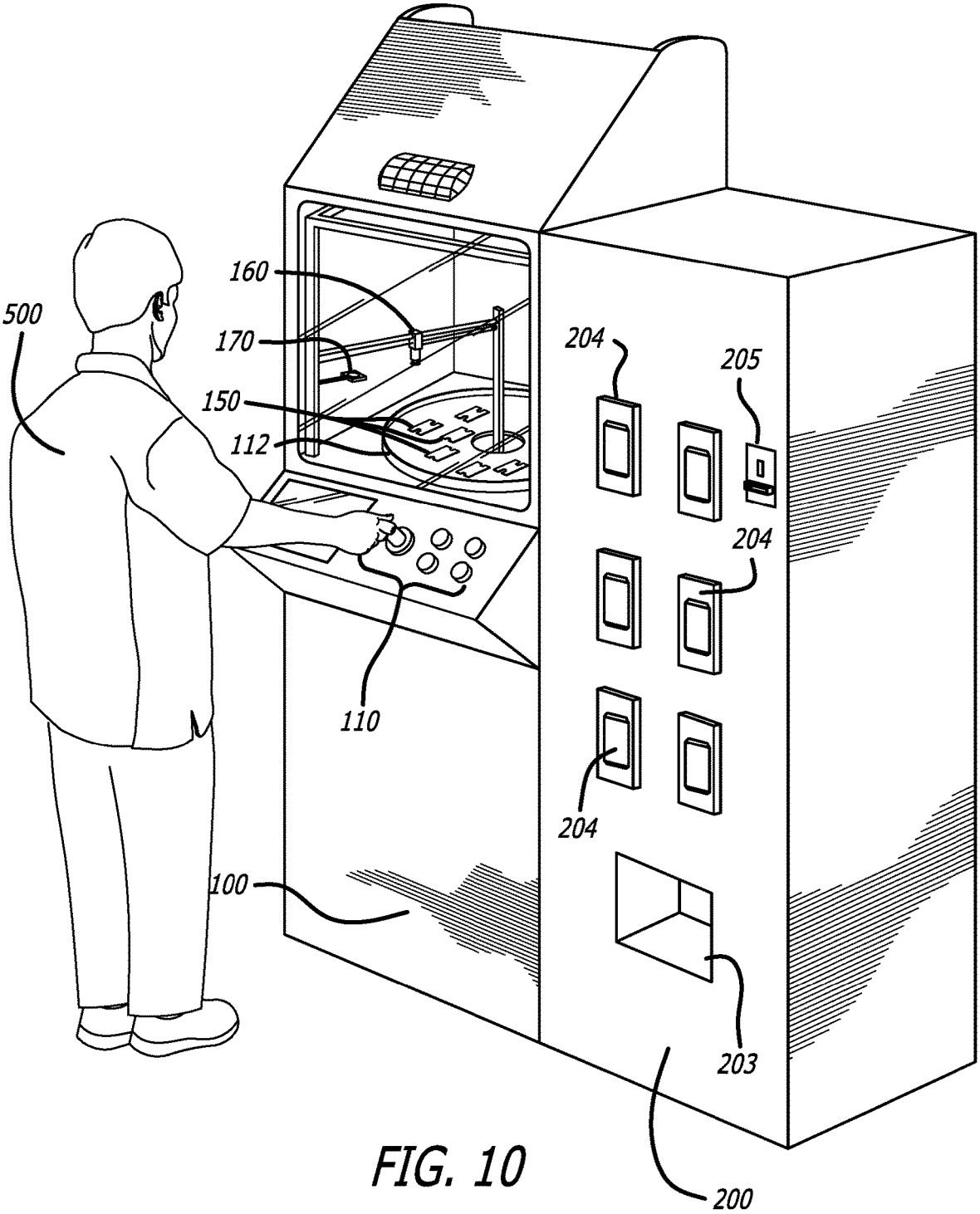
FIG. 10 is an alternate embodiment of the present invention where the beverages in the arcade game are replaced with cards.

FIG. 2 is a perspective view of an exemplary embodiment of the present invention comprising a system including an arcade game 100 and a vending machine 200. The arcade game can be of the type where a pick-up device, probe, switch, or sensor is maneuvered by a player using player controls 110 over a rotating or stationary playing field 112. On the playing field 112 is a plurality of beverages in containers 120, where the playing field 112 preferably includes a variety of beverages such as sodas, energy drinks, etc. The vending machine 200 also dispenses the same beverages as the arcade game 100, and does so in the convention manner for vending machines of this type. The vending machine includes selection buttons 204 with depictions of the various products, which when depressed after appropriate payment results in the vending machine dispensing the selected beverage 99 in the product window 203 (FIG. 9). The arcade game may also pulse the vending machine button when a player wins, simulating depressing the button. The arcade game include player controls 110 for manipulating the pointer or pick-up device (described more fully below), and may also include payment receiving technology or the payment receiving technology 205 may be located solely on the vending machine 200.

Figure 3:
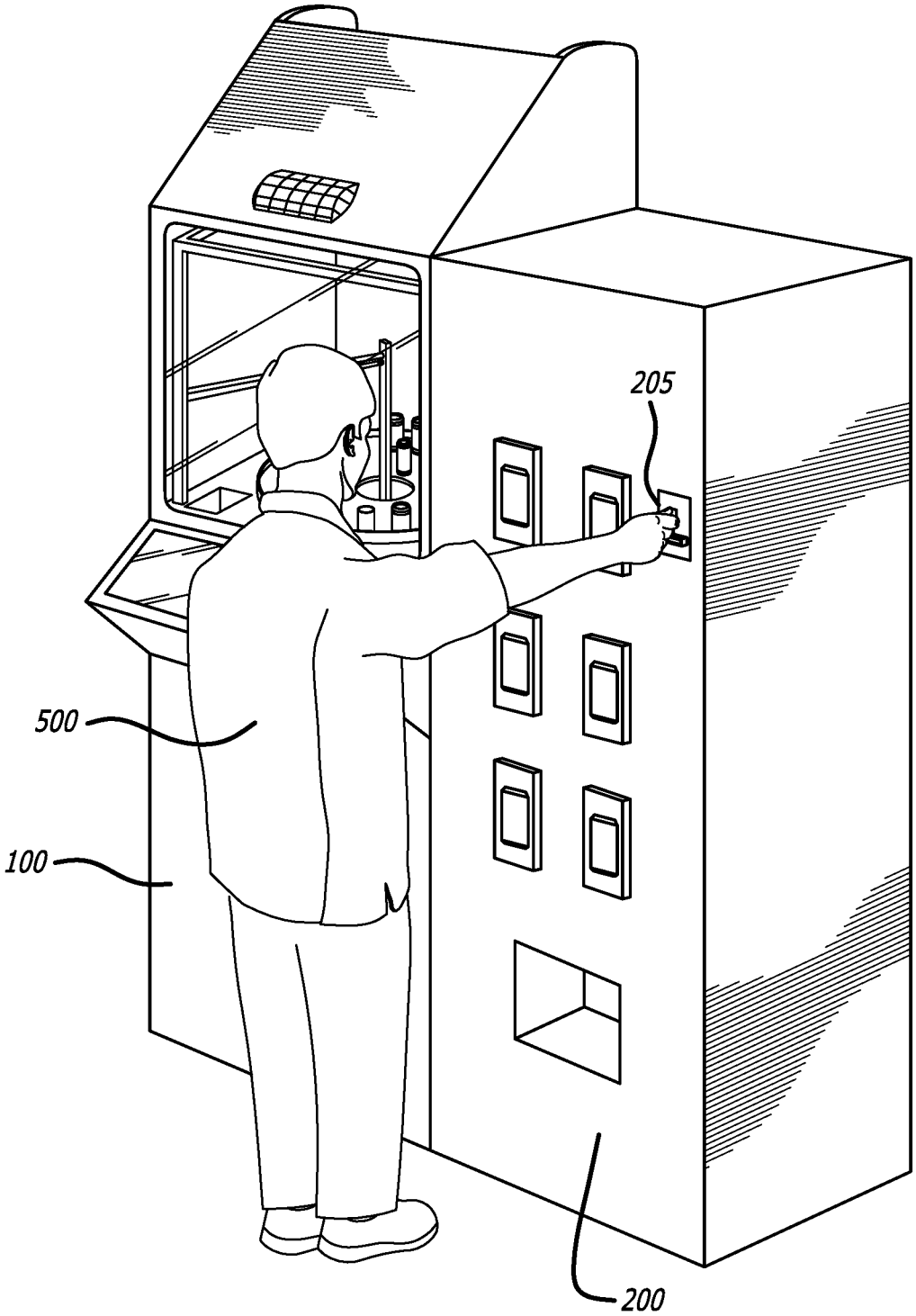
FIG. 3 is a perspective view of a patron purchasing a play for the arcade game with the vending machine.

FIG. 3 illustrates how the system can be used by a patron 500 interested in acquiring a beverage from the system. The patron 500 places a payment (coin, token, magnetic card, bill, etc.) into the payment receptacle 205 on the vending machine 200 (although the payment can also be made on an arcade game payment device not shown). There may be two prices accepted by the payment receptacle 205, a first price using the vending machine 200 to sell or vend a beverage and a second price using the arcade game 100 to attempt to win a beverage. In the first case, the payment of the beverage is a typical cost associated with beverage vending machines, reflective of the value of the beverage, the convenience, and location of the vending machine, and availability of other options. If the payment is made for the first option, the patron presses a button 204, and the beverage is dispensed to the delivery window 203 at the bottom of the vending machine (see FIG. 9).

Figure 4:
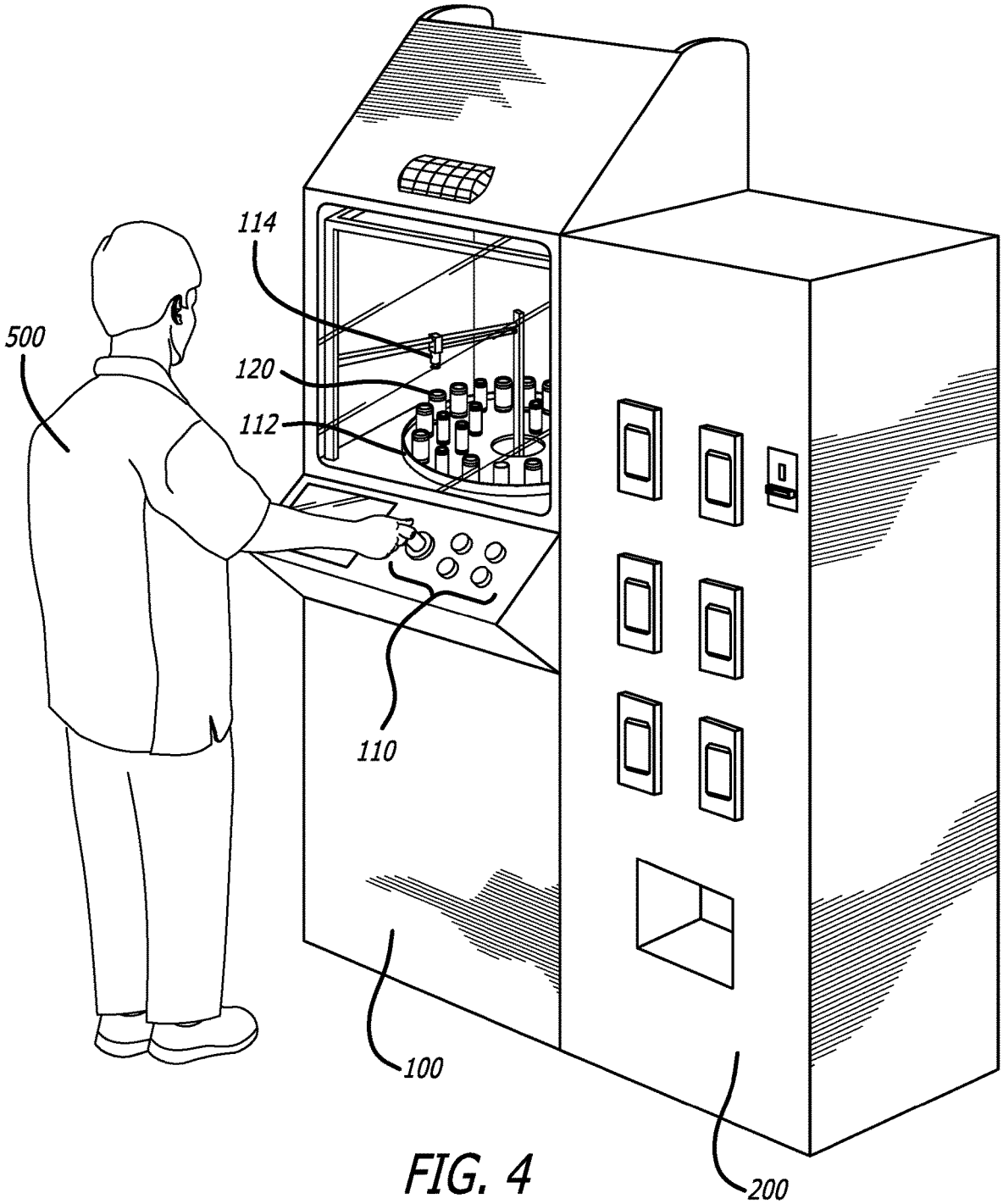
FIG. 4 is a perspective view of a patron using the arcade game to win a beverage from the vending machine.

If payment is made for the second option, the game of skill is played. Generally, the second options is significantly cheaper than the first since the second case involves the patron's desire to win a beverage rather than buy one, by playing a game of skill. The patron 500 places a payment in the vending machine payment receptacle reflective of the second option, and this payment affords the patron a play of the arcade game 100. More specifically, the patron 500 is given the opportunity to "win" a beverage using the arcade game (FIG. 4). If the player is successful, the arcade game 100 will send a signal to the vending machine 200 via the data bus 300, 301 that will cause the vending machine 200 to dispense a beverage won by the patron. There are various ways in which the arcade game 100 can be operated and won, including maneuvering a pick-up device 114 over the plurality of cans 120 arranged on a rotating turntable 112 and attempting to capture/pick-up a can with the pick-up device 114 (which may be a claw, suction cup, or magnetic attachment, or other type of coupling device).

Figure 8:
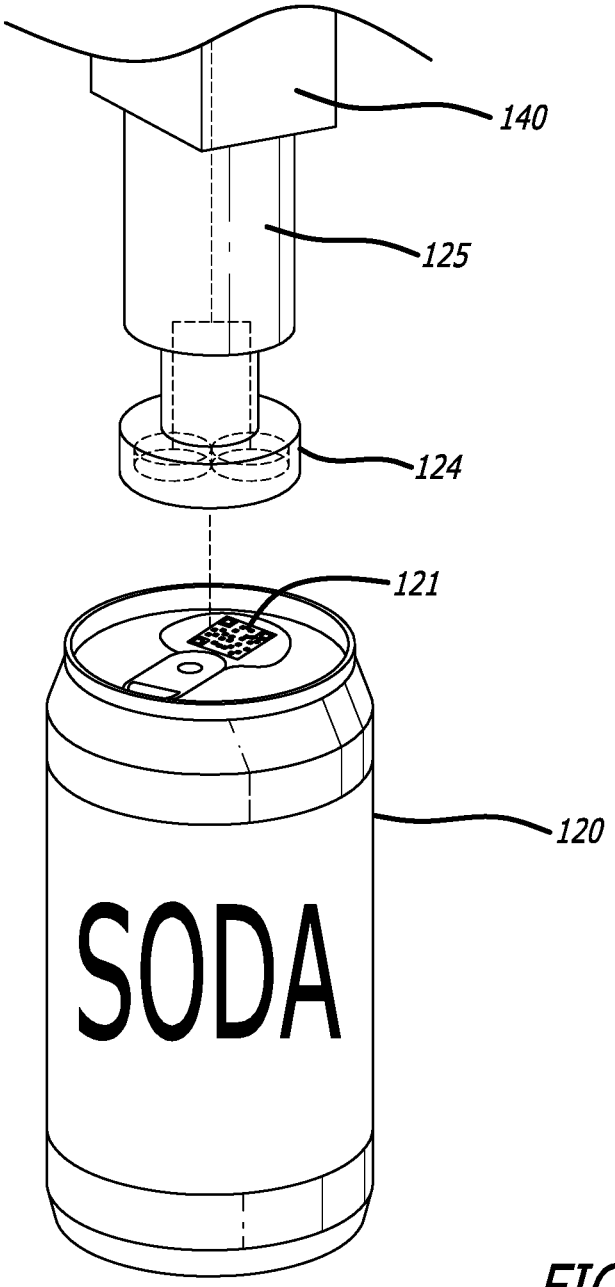
FIG. 8 is an elevated, enlarged perspective view of a code reader for determining a type of beverage acquired.

Alternatively, the game may involve touching or contacting a can with a probe/sensor/reader, where the probe/sensor/reader can optically scan information about the can from a data source, bar code, computer chip on the can. Referring to FIG. 8, the scanner 125 is equipped with an optical reader 124 that when brought in proximity with the can 120 can detect and read a bar code 121 such as a Quick Read Code (QRC) printed or affixed to the top of the can. The scanner 125 can then return to a base location and transmit the information to the vending machine 200 across the data bus 300, 301. The scanning operation can be achieved with either a bar code and bar code reader, a QRC optical label and QRC reader, an RFID chip and RFID reader, an NFC (Near Field Communication) tag and sensor, or any other manner in which a beverage can is interpreted by a machine. If the attempt by the patron 500 is successful, the arcade game sends a signal to the vending machine that a target was hit/prize was won and to dispense the beverage of the type won by the patron in the game. In this manner, the patron gets a beverage and plays a game, and the vender delivers the item to the winner.

Figure 5:
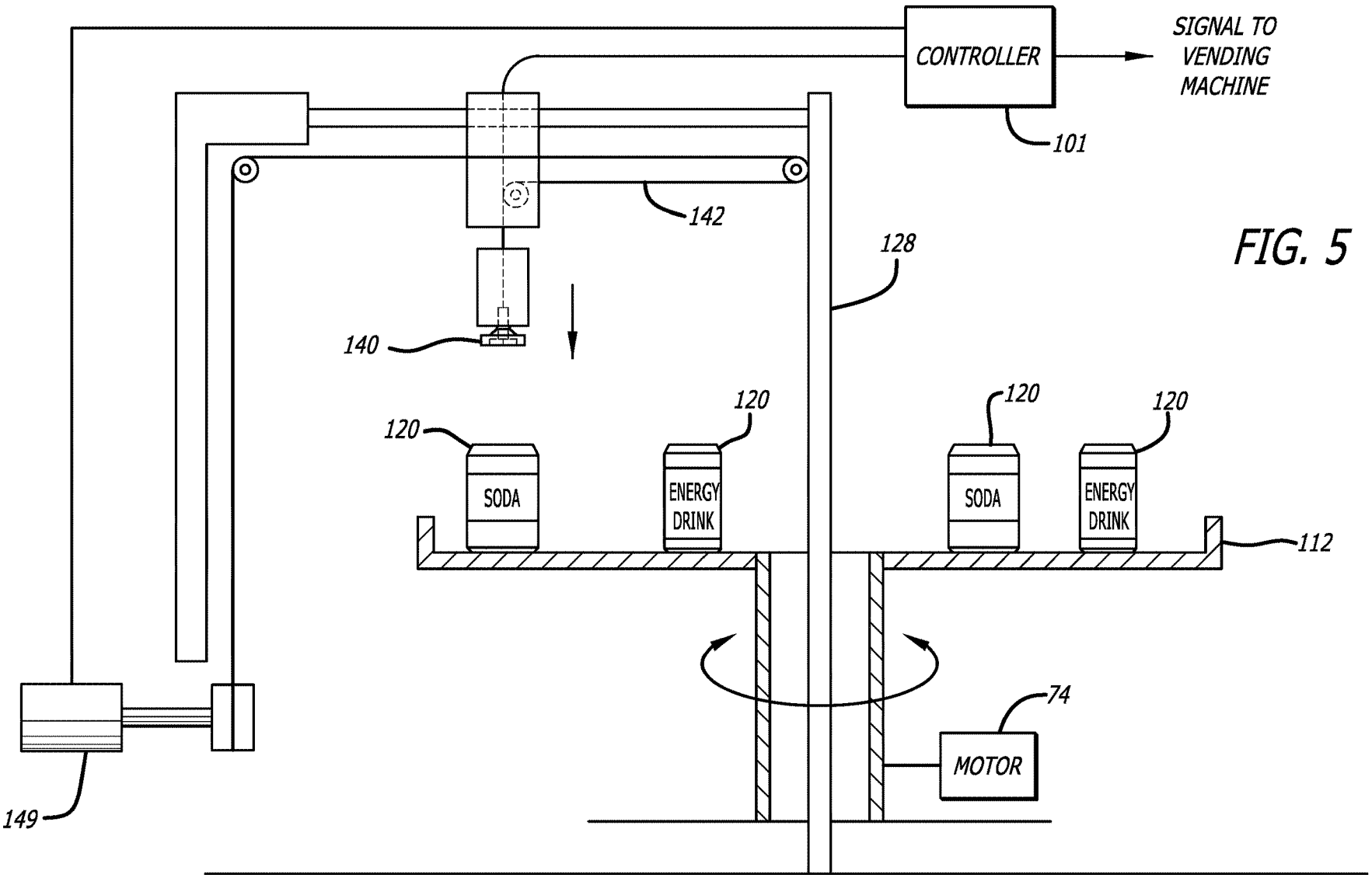
FIG. 5 is a side view of the can acquisition subsystem of a first embodiment of the present invention.

FIG. 5 illustrates the operation of the turntable and arcade game of the present invention. Beverages 120 are disposed on a circular rotating turntable 112 that rotate about a central post 128. Motor 74 rotates the turntable 112 in one or both directions according to the rules of the game. A pick-up device such as a vacuum source and suction cup 140 is mounted on a cable 142 that moves the pick-up device radially along the turntable 112, controlled by motor 149. Motor 149 is controlled by the controller 101, which receives commands from the player controls 110. The controller 101 also controls the vertical position of the pick-up device, which can be automated or player controlled.

Figure 6:
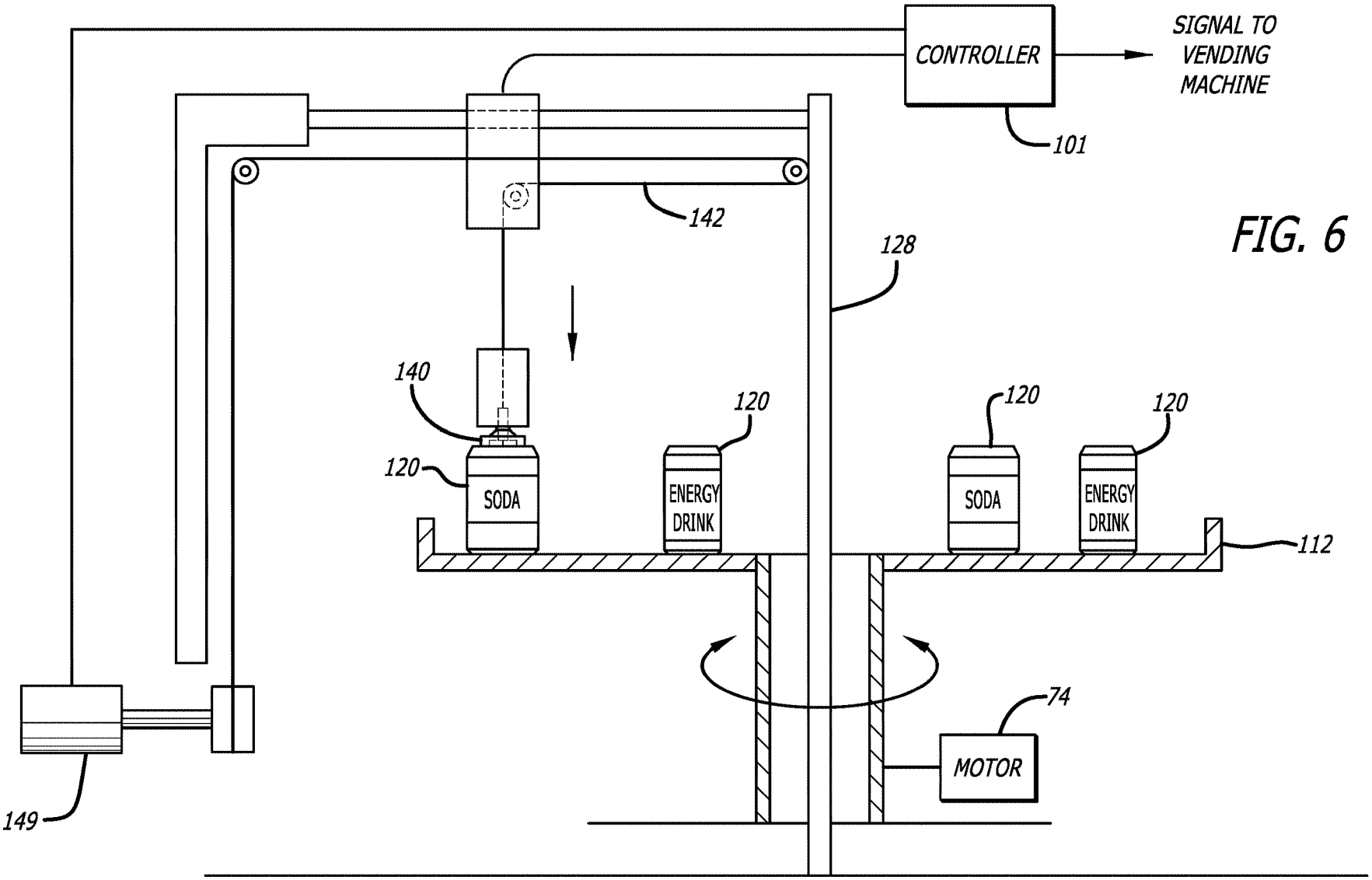
FIG. 6 is a side view of the can acquisition subsystem acquiring a beverage.
Figure 7:
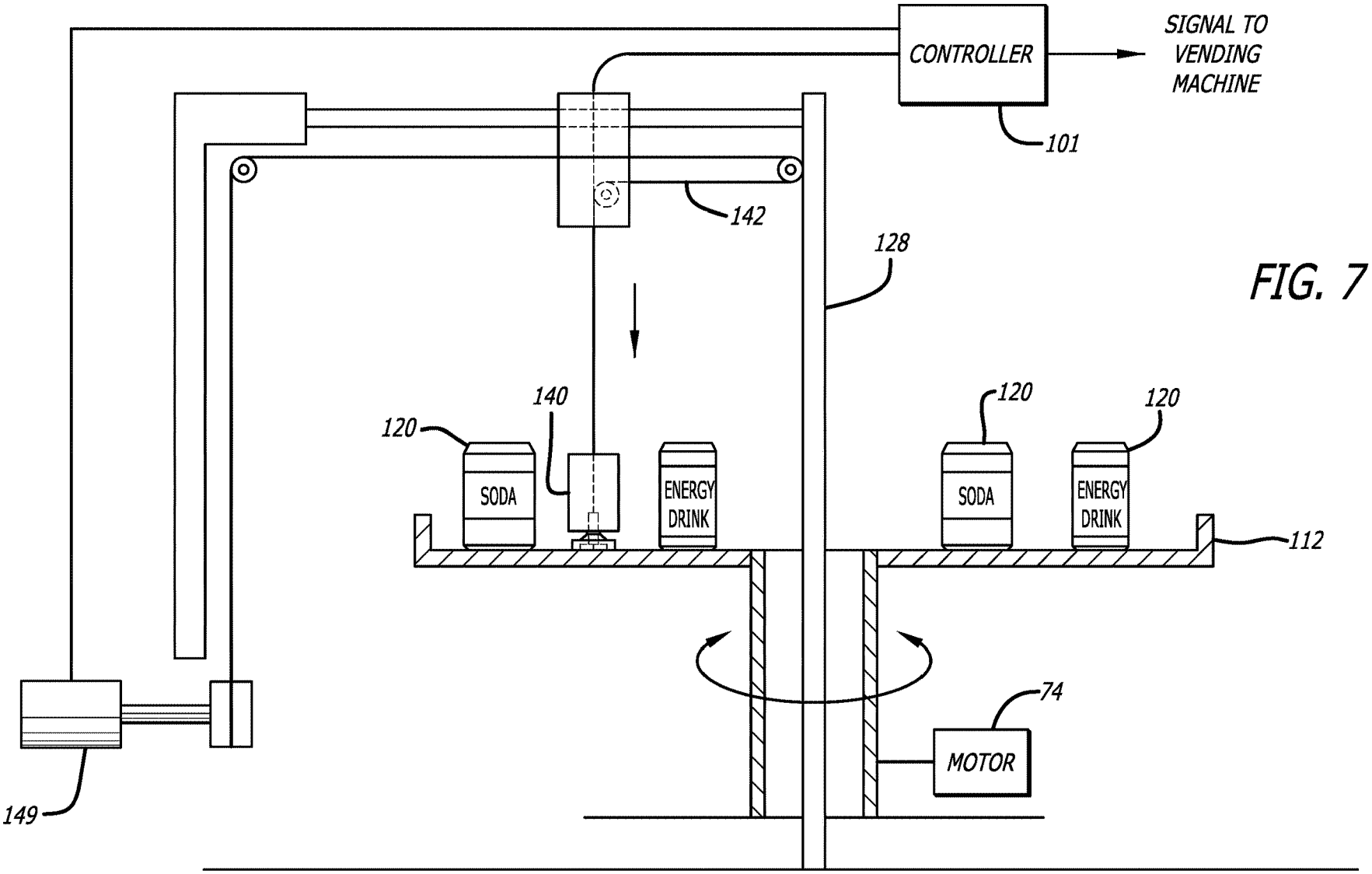
FIG. 7 is a side view of the can acquisition subsystem misacquiring a beverage.

The player typically controls the location of the pick-up device along the radial path with one control and stops or slows the turntable 112 with a second control, although many other options and game attributes are possible. If the pick-up device is lowered precisely onto a can 120 (FIG. 6), the pick-up device will make contact with and capture the can. The pressure switch (not shown) in the pick-up device alerts the controller 101 that solid contact has been made, corresponding to a "win" by the patron. The can may remain on the playing field, and the vending machine will dispense a beverage according to the prize won. If the pick-up device is lowered inaccurately and misses the target (FIG. 7), the pick-up device returns to a home station and no beverage is dispensed. Although a suction connection is described, the prize capture may also be accomplished by another physical connection with the can as by magnetic, claw to lift the can off the table, latching, hooking, or other such methods. When the can is touched by the pick-up device, the sensor, NFC, RFID or other device is read and the information is sent to the vending machine to dispense the prize.

FIGS. 10-16 illustrate another preferred embodiment of the present invention, where the targets are not cans but cards. The cards 150 preferably include graphics or pictures on the cards to let the player know the prize he/she is playing for (soda, energy drink, game credits, cash prizes, etc.), and machine readable information such as a bar code, QRC code, optical code, etc. on or sandwiched inside between two cards. In this case, the cards 150 are placed on the turntable 112 (FIG. 10), and the player attempts to pick up a card using a suction cup or other pick-up device 160. If the card 150 is successfully picked up by the pick-up device 160, it is moved over a scanner 170 that reads the information and forwards a signal to the controller 101 representative of the prize won. The controller 101 sends a signal to the vending machine 200 or prize dispenser with the information to deliver a prize, and then the card 150 is returned to the turn table 112. The card 150 is only transported to the reader 170 when won, and the win may be detected with a vacuum switch or other means. The importance of the card is seen if the items to be won are not suitable for a game, such as potato chips, hot dogs, etc., and where a picture of the item is placed on the card and the prize is retrieved elsewhere.

Figure 11:
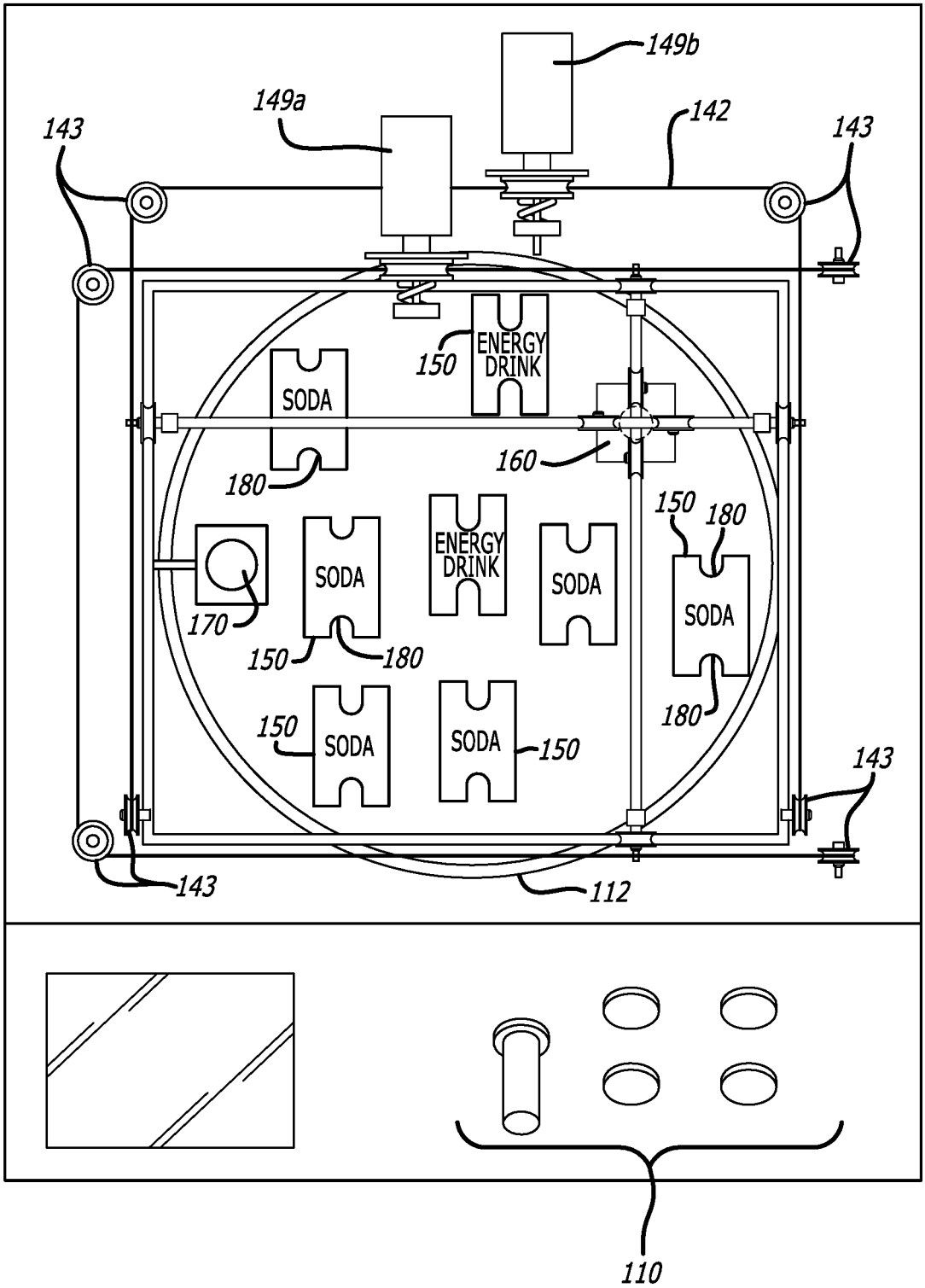
FIG. 11 is a top down view of the playing field of the embodiment of FIG. 10.
Figure 16:
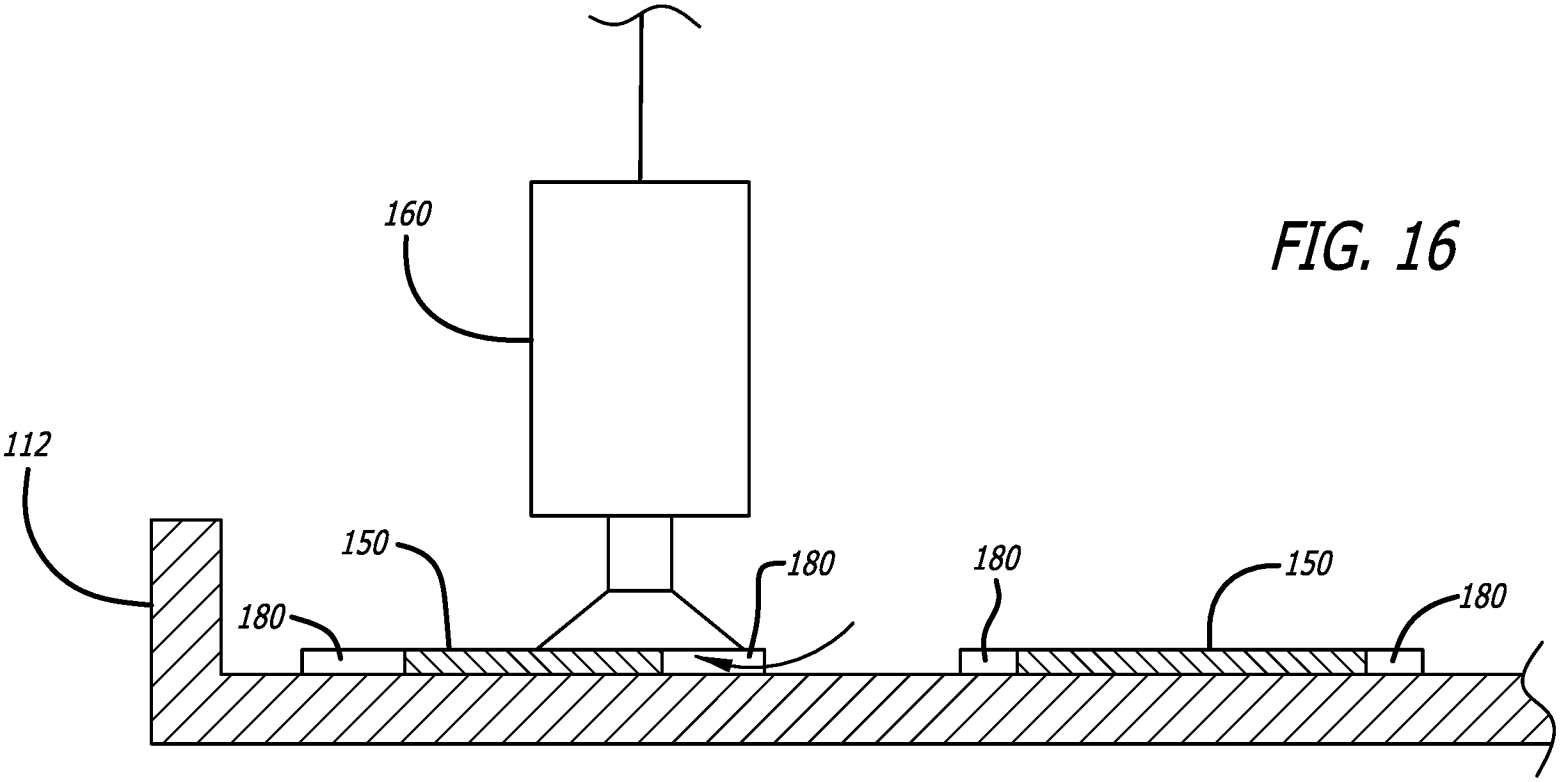
FIG. 16 is an enlarged, cross sectional view of the interaction with the pick-up device and the card in the misaligned case.

FIG. 11 shows a top down view of the playing field 112 of the second embodiment. The cards 150 may be shaped as rectangular with cut-outs at first and/or second ends. The size and number of the cut-outs 180 can affect the difficulty of capturing the card 150, since contact with the cut-out 180 will impede the suction function of the pick-up device 160 and prevent the card 150 from being captured (FIG. 16). Using this technique, different value prizes can be established with different difficulty levels, with larger cut-outs resulting in a smaller target area and a higher level of difficulty.

The movement of the pick-up device is accomplished with cables 142, pulleys 143, and motors 149 as is known in the art and specifically described in U.S. patent application Ser. No. 16/352,532, incorporated herein by reference and not repeated here. The card reader 170 sends a signal to a controller 101 regarding the prize won, and the information is sent to the vending machine by the controller 101 using the data bus 300, 301.

Figure 12:
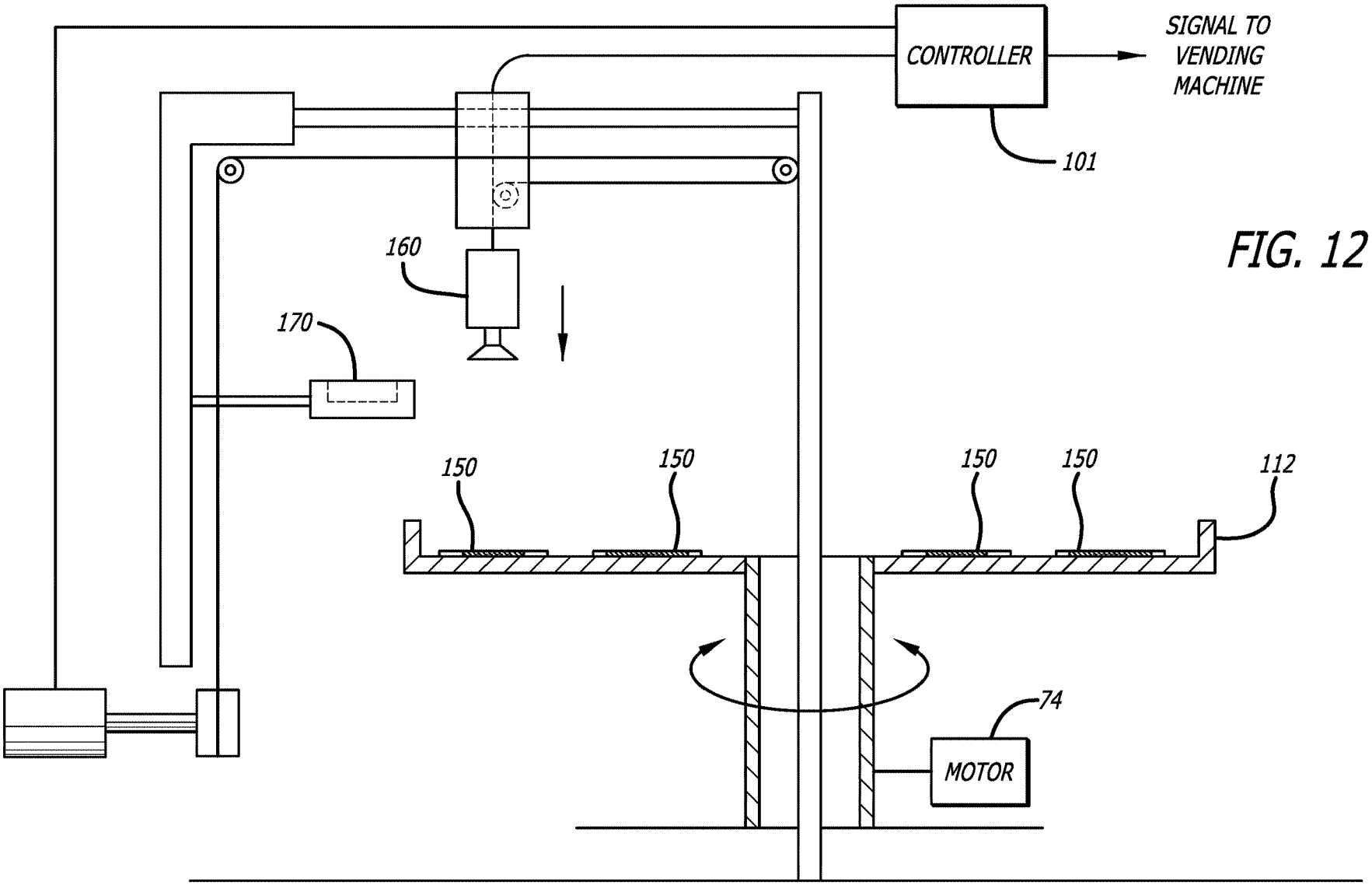
FIG. 12 is a side view of the pick-up device of the embodiment of FIG. 10.
Figure 13:
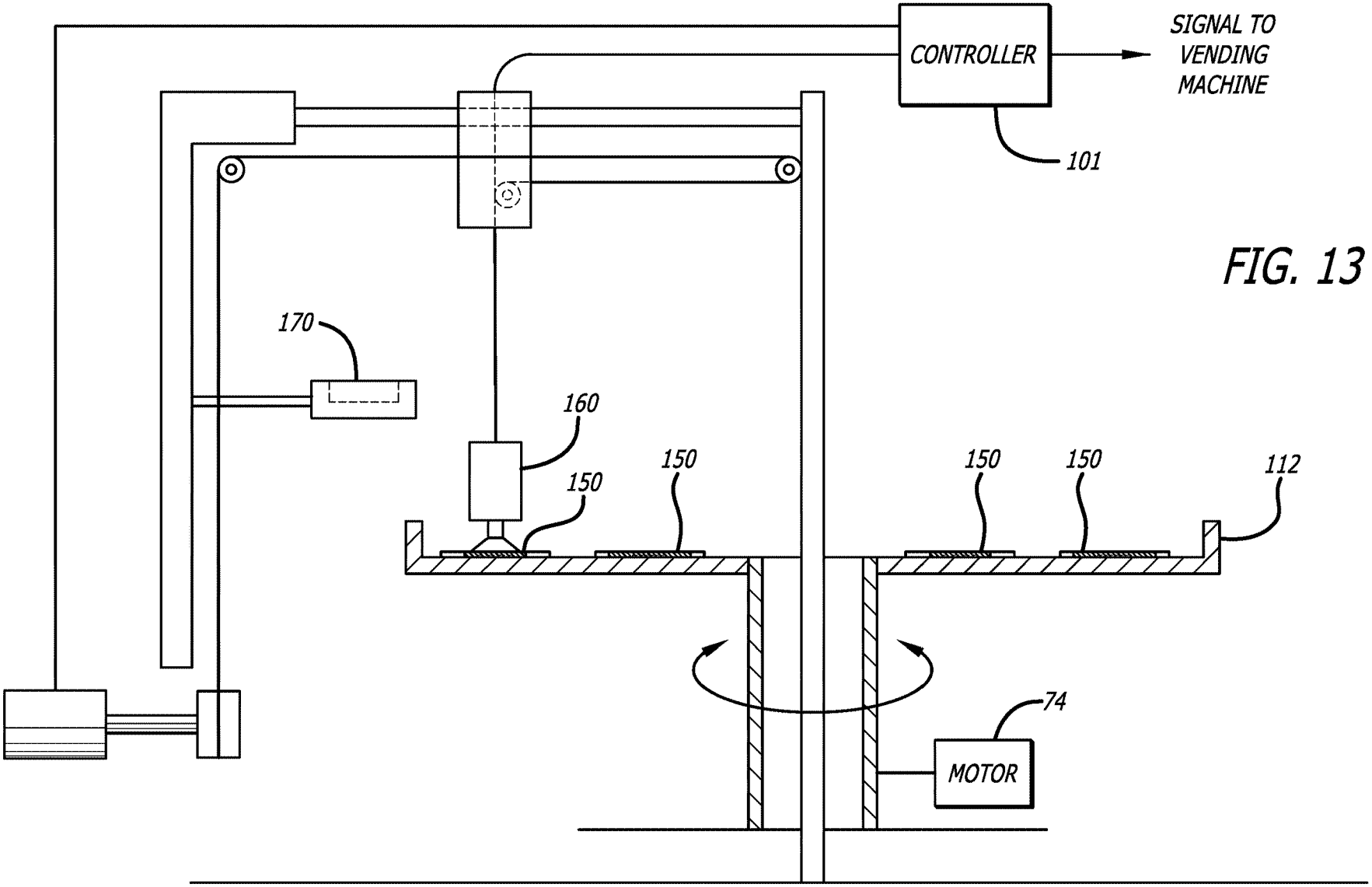
FIG. 13 is a side view of the pick-up device of FIG. 12 acquiring a card/target.
Figure 14:
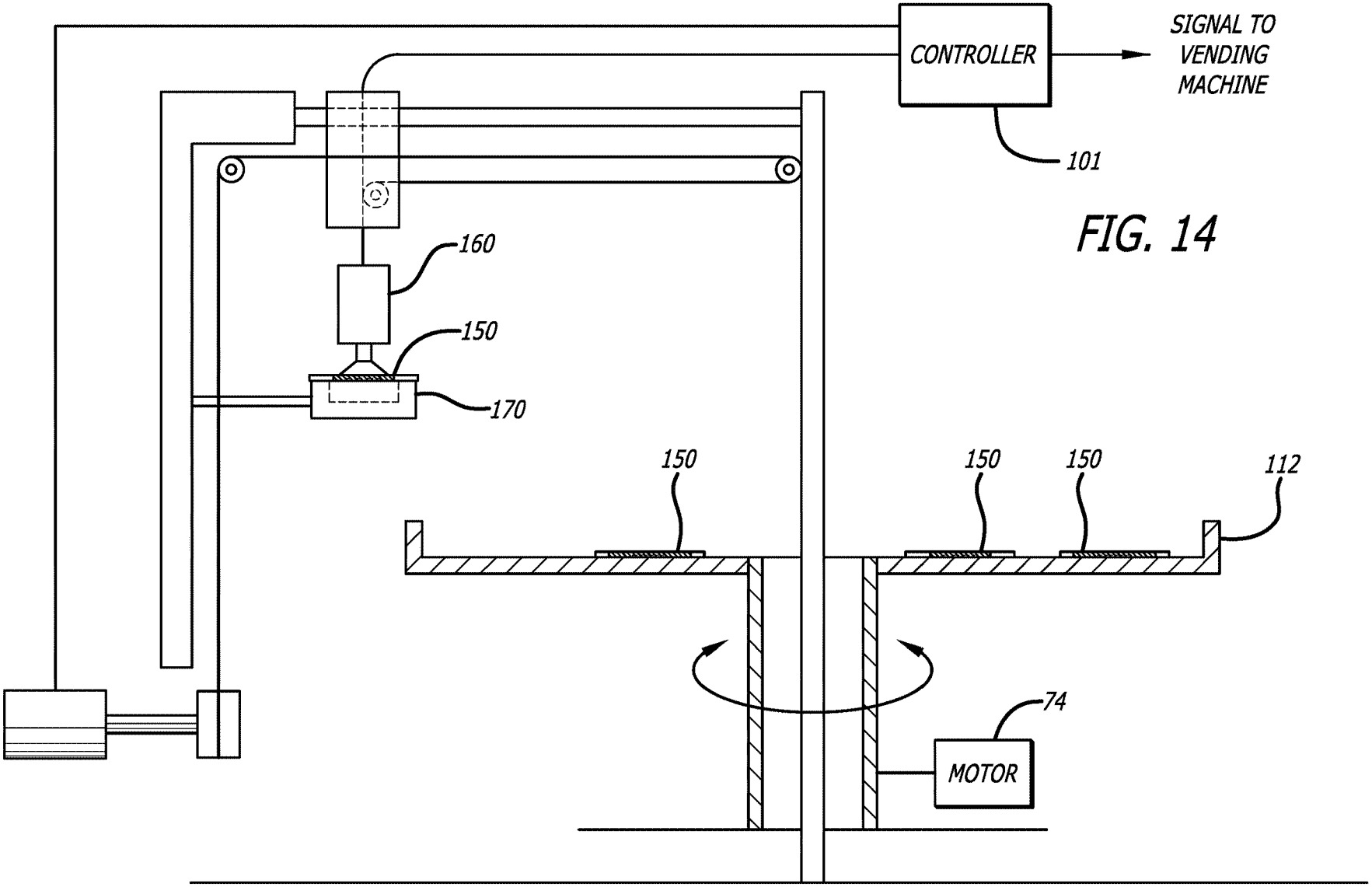
FIG. 14 is a side view of the pick-up device passing the acquired card/target over a code reader.
Figure 15:
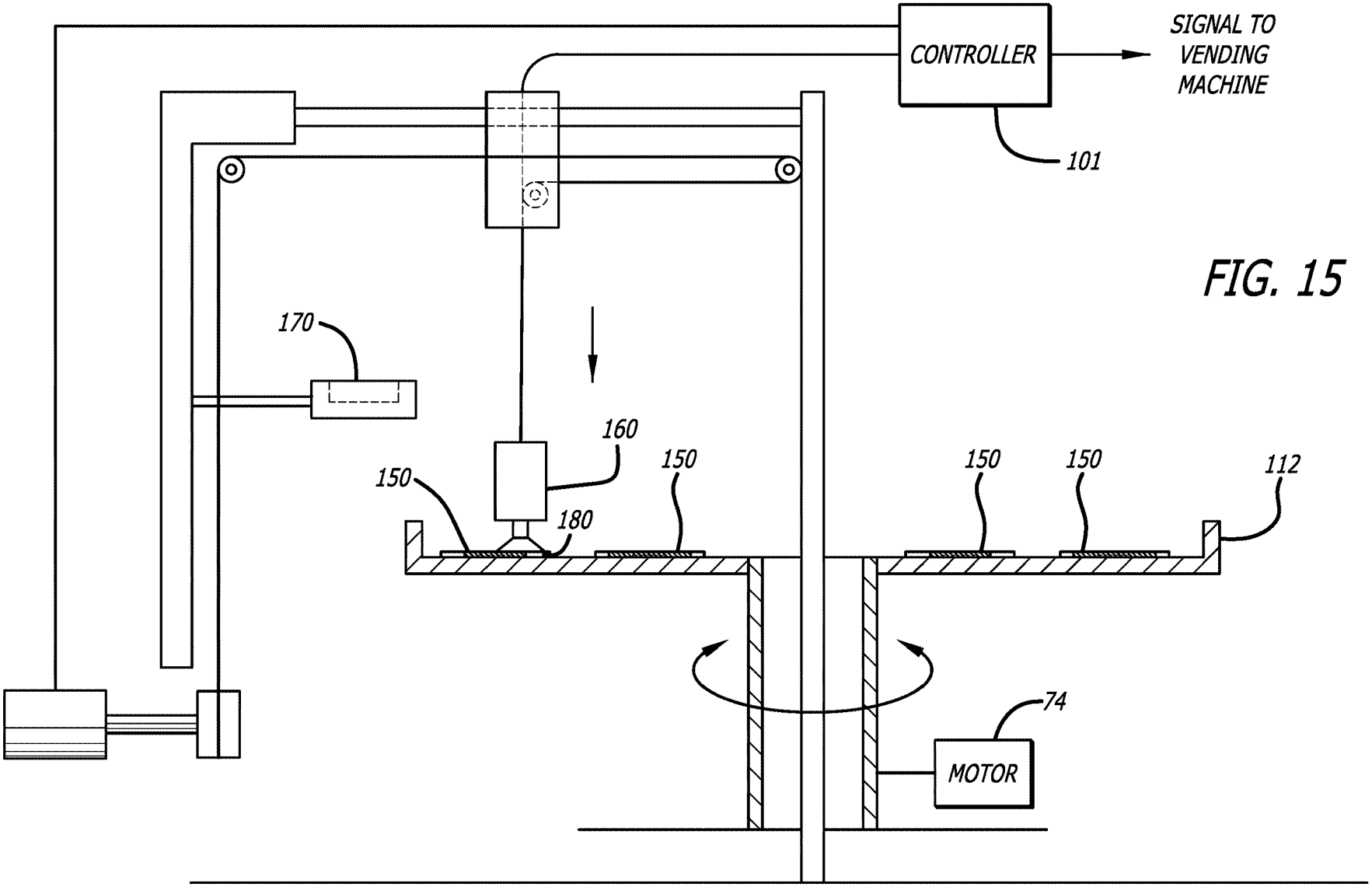
FIG. 15 is a side view of the pick-up device failing to acquire a target.

FIGS. 12-14 illustrate the successful capture and reading of a card 150. The pick-up device 160 is maneuvered over the card and lowered such that the suction cup presses against the card but not over the cut-outs 180. The card 150 is then carried past the reader 170 and the reader sends the information to the controller 101, which then commands the vending machine to dispense the prize. As described above, the card could include an NFC, QRC code or another kind of bar code, an optical symbol, an RFID tag, or any other means for using a machine to extract certain information from the can or card. If the pick-up device 160 is not placed over the card 150, or is placed over part of the cut-out 180 (FIG. 15, 16), then the card is not captured and the attempt is unsuccessful.

Although several preferred embodiments have been described and depicted in the drawings, the invention is not limited to these preferred embodiments or depictions. A person of ordinary skill in the art will readily appreciate many substitutions, modifications, and alternations, and the invention is intended to include all such modifications, alternations, and substitutions. Accordingly, the scope of the invention is properly measured by the words of the appended claims in light of, but not limited by, the foregoing descriptions and depictions in the drawings.

I claim:

1. A vending machine and arcade game joint system, comprising:

an arcade game comprising a first housing, a plurality of targets, a target acquisition device configured to acquire a target from among the plurality of targets, and a set of player controls for manipulating the target acquisition device;

a vending machine comprising a second housing, a storage area containing an inventory of products corresponding to the targets in the arcade game, a delivery system for carrying the products from the storage area to a portal on the second housing; and a data bus connecting the arcade game and the vending machine; and the targets comprise cards with a graphics on a first face corresponding to an associated prize, and machine readable information that is readable by a machine reader inside the arcade game;

wherein the arcade game communicates with the vending machine to deliver a product via the delivery system to the portal, the product associated with a target acquired using the arcade game.

2. The vending machine and arcade game system of claim 1, wherein the data bus is wired.

3. The vending machine and arcade game system of claim 1, wherein the data bus is wireless.

4. The vending machine and arcade game system of claim 1, wherein the targets are containers of a beverage, and the vending machine stores the same beverages in the storage area.

5. The vending machine and arcade game system of claim 4, further comprising a refrigeration unit in the vending machine for keeping the beverages at a desired temperature.

6. The vending machine and arcade game system of claim 4, further comprising a heating unit in the vending machine for keeping food items at a desired temperature.

7. The vending machine and arcade game system of claim 1, wherein the target acquisition device uses a vacuum system to capture the targets.

8. The vending machine and arcade game system of claim 1, wherein the plurality of targets rests on a rotating turntable.

9. The vending machine and arcade game system of claim 8, wherein the turntable stops rotating when the target acquisition device lowers toward a target to extract a target, and resumes once the target is returned to the turntable.

10. The vending machine and arcade game of claim 1, wherein the cards include at least one cut-out area for increasing a difficulty level associated with picking up the card.

11. A vending machine and arcade game joint system, comprising:

an arcade game comprising a first housing, a plurality of targets, a target acquisition device configured to acquire a target from among the plurality of targets, and a set of player controls for manipulating the target acquisition device;

a vending machine comprising a second housing, a storage area containing an inventory of products corresponding to the targets in the arcade game, a delivery system for carrying the products from the storage area to a portal on the second housing; and a data bus connecting the arcade game and the vending machine;

wherein the arcade game communicates with the vending machine to deliver a product via the delivery system to the portal, the product associated with a target acquired using the arcade game; and wherein the target acquisition device uses an optical reader to identify a type of target.

* * * * *